US011651909B2

(12) United States Patent
Korbel et al.

(10) Patent No.: US 11,651,909 B2
(45) Date of Patent: May 16, 2023

(54) SPRING DRIVE CAM FOR A SPRING DRIVE OF A CIRCUIT BREAKER

(71) Applicant: Hitachi Energy Switzerland AG, Baden (CH)

(72) Inventors: Jakub Korbel, Baden (CH); Matt Cuppett, Uniontown, PA (US); Brian Christopher, Smithfield, PA (US); Richard Thomas, Borlänge (SE); Sami Kotilainen, Niederrohrdorf (CH); Staffan Jacobsson, Grangärde (SE); Benny Wedin, Grängesberg (SE); Francesco Agostini, Zürich (CH)

(73) Assignee: Hitachi Energy Switzerland AG, Baden (CH)

( * ) Notice: Subject to any disclaimer, the term of this patent is extended or adjusted under 35 U.S.C. 154(b) by 5 days.

(21) Appl. No.: 17/404,287

(22) Filed: Aug. 17, 2021

(65) Prior Publication Data

US 2022/0059297 A1 Feb. 24, 2022

(30) Foreign Application Priority Data

Aug. 19, 2020 (EP) ..... 20191692

(51) Int. Cl.
*H01H 3/38* (2006.01)

(52) U.S. Cl.
CPC ..... *H01H 3/38* (2013.01); *H01H 2235/01* (2013.01)

(58) Field of Classification Search
CPC ..... H01H 3/38; H01H 2235/01; H01H 3/30; H01H 3/06; H01H 5/00; H01H 3/42; H01H 3/3015
USPC ..... 200/318–325, 303, 307, 329, 400, 401, 200/500, 542, 573, 574
See application file for complete search history.

(56) References Cited

U.S. PATENT DOCUMENTS

| | | | | |
|---|---|---|---|---|
| 4,649,244 | A * | 3/1987 | Baginski | H01H 3/30 200/325 |
| 5,541,378 | A * | 7/1996 | Niklaus | H01H 3/3026 74/567 |
| 8,093,984 | B2 | 1/2012 | Hoffmann et al. | |
| 2015/0248976 | A1 | 9/2015 | Pisu et al. | |

FOREIGN PATENT DOCUMENTS

| | | | |
|---|---|---|---|
| DE | 2015630 | A1 | 10/1971 |
| DE | 202009002929 | U1 | 7/2009 |
| GB | 1583382 | A | 1/1981 |
| JP | S549875 | U | 1/1979 |

OTHER PUBLICATIONS

European Patent Application No. EP 20191692.1, Extended European Search Report dated Feb. 17, 2021, 8 pages.

* cited by examiner

*Primary Examiner* — Edwin A. Leon
*Assistant Examiner* — Iman Malakooti
(74) *Attorney, Agent, or Firm* — Sage Patent Group

(57) ABSTRACT

Provided is a spring drive cam for a spring drive of a circuit breaker including a disc-like shape configured for rotating around a rotation axis in the spring drive, whereby the disc-like shape comprises a radius (R) that changes depending on an angle (α) of the radius (R) relative to a base angle (α0), and whereby a rate (dR/dα) defined by a change of the radius (R) per change of the angle (α) is ≤0.3 mm/°.

11 Claims, 3 Drawing Sheets

SPRING DRIVE CAM FOR A SPRING DRIVE OF A CIRCUIT BREAKER

TECHNICAL FIELD

The invention relates to a spring drive cam for a spring drive of a circuit breaker comprising a disc-like shape configured for rotating around a rotation axis in the spring drive. The invention further relates to the spring drive comprising the cam. The invention even further relates to the circuit breaker comprising the spring drive.

BACKGROUND ART

Spring drives are commonly used operating mechanisms, OM, of circuit breakers, CB, such as for example medium voltage circuit breakers, MVCB, high voltage circuit breakers, HVCB, or generator circuit breakers, GCB. Spring drives have to offer reliable functionality with minimum maintenance for long life span. In particular, the spring drives have to fulfil open-close-open, OCO, requirement specification. This means an open operation must be followed by a close operation by a close spring and during this close operation, an opening spring of the spring drive must be charged again, and the spring drive must be able to perform a second open operation. The interaction between the open and close springs is commonly realized by a cam.

In order to secure reliable functionality during a whole service life of the spring drive, it's necessary to estimate an energy balance between the open and close springs, to determine minimal latching close spring preload and to add some preload to compensate aging effects, stress relaxation or increase of a friction occurred by oxidation. Such procedure, however, leads to higher closing speeds compared to hydromechanical drives and can stress arcing contacts of the HVCB, MVCB or GCB to its mechanical limits.

Typical arcing contacts in the CB consists of a contact tulip and a contact plug. During the closing operation an impact between the contact plug and the contact tulip occurs. The closing speed is a key factor, which determines load of the arcing contacts. If the speed reaches a critical value, significant bouncing of the contact tulip occurs, which could lead to mechanical failures of the contact tulip. If the closing speed reaches the critical value, contact fingers of the contact tulip will bounce, which concentrates the stress at roots of the contact fingers and fatigue cracks can start to grow. Further grow of the cracks can completely detach the contact fingers, which can lead to a complete malfunction of the circuit breaker.

SUMMARY OF INVENTION

It is therefore an object of the invention to provide an improved circuit breaker, an is improved spring drive for the circuit breaker and/or an improved cam for the spring drive, which are characterized by an improved whole service life time.

The object of the invention is solved by the features of the independent claims. Modified implementations are detailed in the dependent claims.

Thus, the object is solved by a spring drive cam for a spring drive of a circuit breaker comprising a disc-like shape configured for rotating around a rotation axis in the spring drive, whereby the disc-like shape comprises a radius that changes depending on an angle $\alpha$ of the radius relative to a base angle $\alpha_0$, and whereby a rate $dR/d\alpha$ defined by a change of the radius per change of the angle $\alpha$ is $\leq 0.3$ mm/°.

During close operation of a close spring of the spring drive, typically a roller of the spring drive interacts with the cam and transmits the rotation respectively motion of the cam through a linkage of the spring drive to an interrupter of the circuit breaker. Thereby, the profile of the cam is the key factor that influences a closing travel curve and velocity of the spring drive. The cam's profile is defined by the angle and the radius of the cam in respect to the base angle. The rate, i.e. the change of the radius per change of the angle, basically defines a steepness of the radius-angle curve. Experimental tests demonstrated that the rate of 0.3 mm/° resulted in a rotational speed reduction which significantly prolongs a fatigue life of a contact tulip of the circuit breaker and minimizes a risk of mechanical failures during whole service life time, compared to prior art cams.

Another benefit of the proposed cam is that an energy balance between a closing and opening spring of the spring drive. Thereby, energy balance or excess energy is calculated as a subtraction of closing spring from total losses i.e. sum of open spring energy and frictional dissipation. The percentage of excess energy is estimated from the close spring energy and shall have margin of the excess energy to secure the safe functionality. Multi-body simulation demonstrated that the proposed cam has 2.3% higher excess energy for the same close spring preload, compared to prior at cams. Thus, for achieving the same excess energy the close spring can be less preloaded in respect to a minimal latching preload.

Generally, it is beneficial to have a high rate at the beginning of the radius-angle curve, because kinetic energy is rising and the close spring are fully charged, thus the highest spring force is utilized. On the other hand, the rate should be as low as possible when the impact of an arcing contact occurs. Therefore, it's beneficial to have variable rate of the cam as proposed by the present solution, which equally addresses both requirements. The proposed cam comprises a high rate in the beginning of a stroke, while simultaneously the rate during the arcing contact impact is significantly lower. The behavior of the proposed cam suitable for low arcing contact impact speed was studied by multi-body dynamic simulation. The theoretical predictions of the travel curves as well as the speed was validated experimentally with a full scale test and showed very good match between the test and simulations.

For the proposed cam, it was shown that an impact speed occurs at 143 mm of the stroke, which corresponds to time 0.05 s after a trip signal. Prior art cams reached impact speeds of 4 m/s, while the proposed cam with reduced rate reached impact speeds of 3.2 m/s. Prior art cams, however, could not reach required maximal impact speeds. Thus, the proposed cam represents a valid solution for mechanically robust tulip. In other words, the proposed cam solves the root cause of prior art's problem of high closing velocity. In sum, the proposed spring drive cam is suitable for low impact speed of the arcing contact, provides longer fatigue life and improved robustness of the arcing contact and provides a higher excess energy for the closing operation.

Generally, the circuit breaker can be used for interrupting a current, when an electrical fault occurs. Specifically, the circuit breaker may have the task of opening conducting terminals and keeping them far apart from one another in order to avoid a current flow, even if high electrical potential is originating from the electrical fault itself. The circuit breaker can be provided as a medium voltage circuit breaker, MVCB, as a high voltage circuit breaker, HVCB, or as a generator circuit breaker, GCB. The term high voltage may refer to voltages higher than 72.5 kV. The circuit breaker may have to be able to carry high nominal currents of 5000 A to 6300 A and to switch very high short circuit currents of 63 kA to 80 kA at very high voltages of 550 kV to 1200 kV. Compared thereto, MVCBs typically brake lower voltages and GCB braker higher currents.

The cam may comprise a flat, round-like shape of which the radius differs as per actual angle. The cam is rotationally hold by the spring drive. In its initial position, for example when the circuit breaker is conducting, the cam may be in its initial rotational position defined by the base angle $\alpha_0$. Such way the base angle $\alpha_0$ may be defined as horizontal line or the like.

In a preferred implementation the rate $dR/d\alpha$ is <0.28 mm/°, 0.28 mm/° and/or constant. In particular the rate of 0.28 mm/° allows to very effectively reduce a closing speed of the cam during impact of the arcing contact of conducting terminals, whereas, compared to prior art cams, the rate in a beginning of a stroke is increased and simultaneously the rate during the arcing contact impact is reduced. The term constant means that the rate may be constant in a range of +/−5 or 10%.

According to a further preferred implementation, for the rate $dR/d\alpha$ 0.3 mm/° or ≤0.28 mm/°, the radius R is ≥82 mm or ≥92 mm and ≤125 mm or ≤115 mm. In a further preferred implementation, for the rate $dR/d\alpha \leq 0.3$ mm/° or ≤0.28 mm/°, the angle $\alpha$ is ≥95° or ≥105° and ≤210° or ≤200°. Preferably, the rate $dR/d\alpha$ is constant for the radius R≥82 mm or ≥92 mm and ≤125 mm or ≤115 mm and/or for the angle $\alpha \geq 95°$ or ≥105° and ≤210° or ≤200°.

Generally, the radius may comprise an arbitrary value. According to a further preferred implementation, whereby, for any rate dR/da, the radius R is ≥40 and ≤130 mm. In a further preferred implementation, for the radius R<82 mm or <92 mm and/or the angle $\alpha$<95° or <105°, the rate $dR/d\alpha$ is >0.3 mm/°, and/or, for the radius R>125 mm or >115 mm and/or the angle $\alpha$>210° or >200°, the rate $dR/d\alpha$ is <than the rate $dR/d\alpha$ of 0.3 mm/°. In particular, for the radius R<82 mm or <92 mm and/or the angle $\alpha$<95° or <105°, the rate $dR/d\alpha$ is >0.28 mm/°, and/or, for the radius R>125 mm or >115 mm and/or the angle $\alpha$>210° or >200°, the rate $dR/d\alpha$ is <than the rate $dR/d\alpha$ of 0.28 mm/°. Thus, outside of the radius R<82 mm or <92 mm and/or the angle $\alpha$<95° or <105° and/or the radius R>125 mm or >115 mm and/or the angle $\alpha$>210° or >200° the rate $dR/d\alpha$ may have a respective arbitrary value.

The object is further solved by a spring drive comprising the cam as described before, an opening spring configured for opening the circuit breaker and a closing spring configured for closing the circuit breaker and reloading the opening spring, whereby the opening spring and the closing spring are in rotational contact with the cam. In a preferred implementation of the spring drive, the rate $dR/d\alpha \leq 0.3$ mm/° yields a rotational speed of the cam of ≤4000°/s, 4600°/s or 5100°/s. Which such value i.e. in particular a constant speed of 4600°/s, full revolution can be achieved in less than 70 ms.

The object is even further solved by a circuit breaker comprising the spring drive as described before and a couple of conducting terminals, whereby the spring drive is configured for moving at least one of the conducting terminals for electrically connecting and disconnecting the conducting terminals.

In a preferred implementation of the circuit breaker according to the previous circuit breaker claim, whereby one of the conducting terminals is provided as contact plug and the other of the conducting terminals is provided as corresponding contact tulip, whereby the conducting terminals are arranged in coaxial arrangement and at least one of the conducting terminals is arranged movable relative to the other of the of the conducting terminals.

BRIEF DESCRIPTION OF THE DRAWINGS

These and other aspects of the invention will be apparent from and elucidated with reference to the implementations described hereinafter.

In the drawings.

DETAILED DESCRIPTION OF EXEMPLARY IMPLEMENTATIONS

Figure 1:
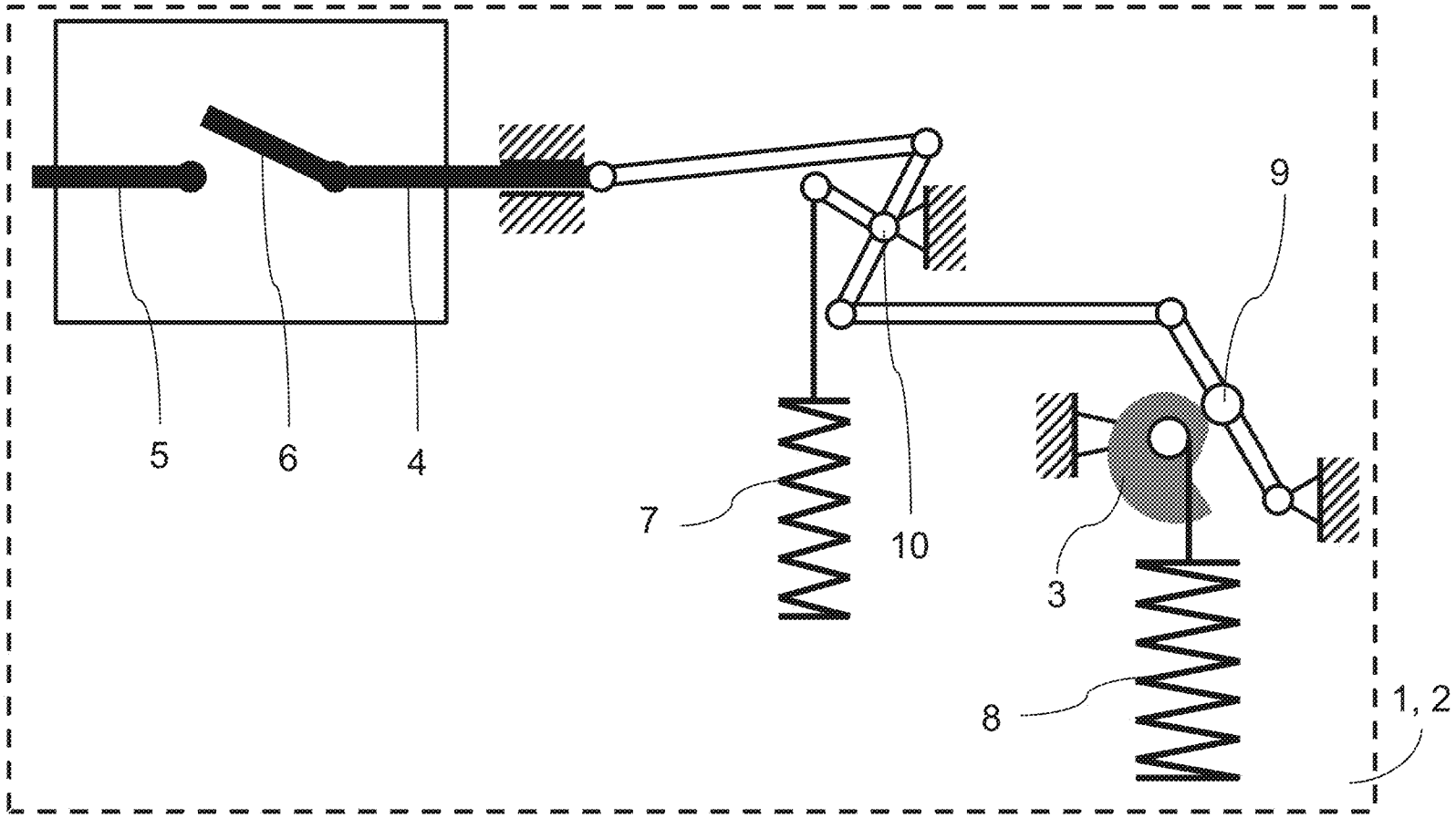
FIG. 1 shows a spring drive of a high voltage circuit breaker comprising a spring drive cam according to a preferred implementation in a schematically view.
Figure 2:
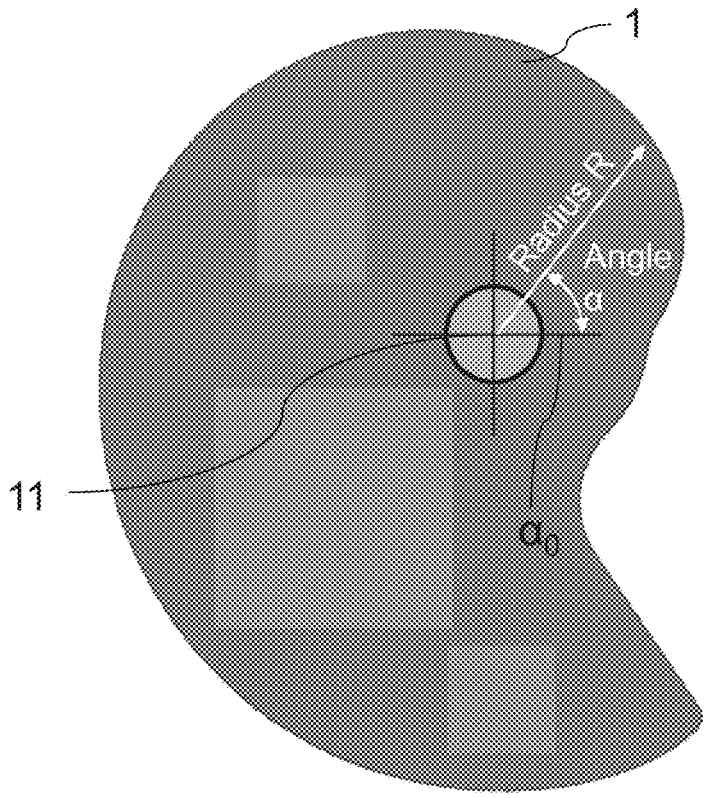
FIG. 2 shows the spring drive cam of FIG. 1 in a schematically top view.

FIG. 1 shows in a schematically view a spring drive 1 of a high voltage circuit breaker 2, only indicated, comprising a spring drive cam 3 according to a preferred implementation. FIG. 2 shows the spring drive cam 3 in an enlarged view.

The circuit breaker 2 comprises a couple of conducting terminals 4, 5 as arcing contacts, only schematically depicted, which are actuated by an interrupter 6 of the spring drive 1, indicated by a dotted line, for interrupting a current flowing between the conducting terminals 4, 5. One of the conducting terminals 4 is provided as contact plug and the other of the conducting terminals 5 is provided as corresponding contact tulip. The conducting terminals 4, 5 respectively the contact plug and the contact tulip are arranged in coaxial arrangement. The interrupter 6 moves at least one of the conducting terminals 4, 5 relative to the other of the of the conducting terminals 4, 5 in axial direction for electrically disconnecting respectively connecting the conducting terminals 4, 5.

The spring drive 1 further comprises an opening spring 7 and a closing spring 8 for opening respectively closing the circuit breaker 2. An interaction between opening spring 7 and closing spring 8 is realized by the cam 3. Specifically, during close operation of the spring drive 1, a roller 9 interacts with the cam 3 and transmits the motion through a linkage 10 of the spring drive 1 to the interrupter 6. A first open operation is followed by a close operation, during which the opening spring 7 is charged again so that the spring drive 2 becomes able to perform a second open operation.

Thereby, the profile of the cam 3 influences a closing speed and velocity of the spring drive 1. If the speed reaches a critical level, significant bouncing of the contact tulip occurs, which could lead to mechanical failures of the contact tulip and thus of the circuit breaker 2.

In order to ensure that the closing speed does not exceed critical level, the disc-like shaped spring drive cam 3 as depicted in greater detail level in FIG. 2 comprises a radius R that changes depending on an angle $\alpha$ of the radius R relative to a base angle $\alpha_0$ if the cam 3 rotates around a rotation axis 10, whereby a rate $dR/d\alpha$ defined by a change of the radius R per change of the angle $\alpha$ is 0.28 mm/°. The base angle $\alpha_0$ is the position of the cam in a base position where conducting terminals 4, 5 are electrically conducting and, as can be seen from FIG. 2, extends in horizontal direction.

Figure 3A:
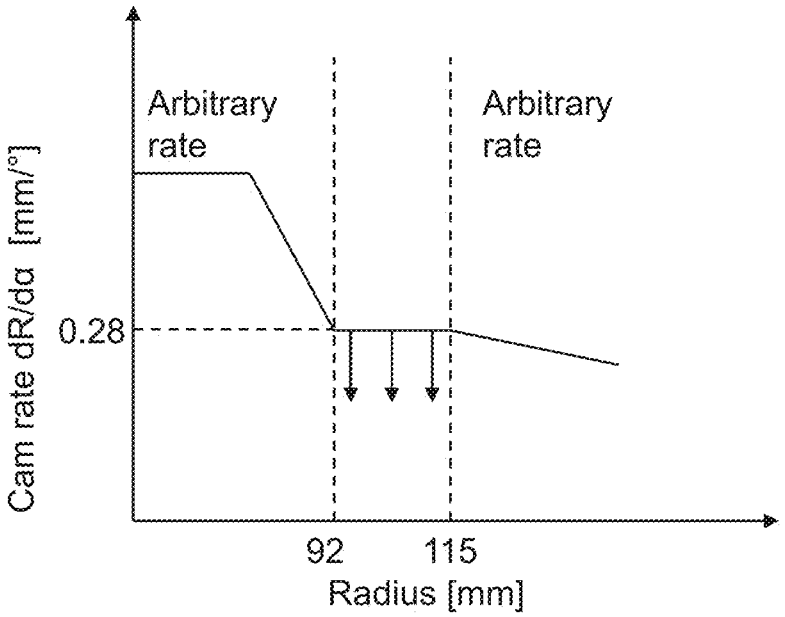
FIGS. 3*a*-3*b* show cam rate/radius and cam rate/angle diagrams of the spring drive cam of FIG. 1.
Figure 3B:
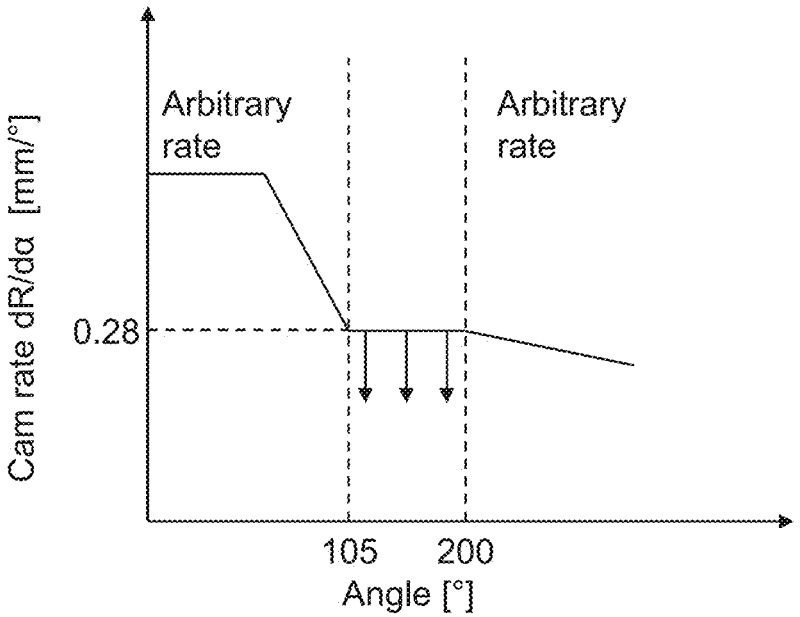

Thereby, the rate dR/dα is constant or at least nearly constant for the radius R in the range between 92 mm and 115 mm, as can be seen from FIG. 3*a*, and for the angle α in the range between 105° and 200°, as can be seen from FIG. 3*a*. For smaller and greater radius R and angle α the rate dR/dα may generally have an arbitrary value, whereby, as can be seen from FIGS. 3*a* and 3*b*, the rate dR/dα is higher than 0.28 mm/° for radius R and angle α smaller than 92 mm respectively 105° and lower than 0.28 mm/° for radius R and angle α greater than 115 mm respectively 200°. Generally, the radius R of the spring drive cam 3 is ≥40 and ≤130 mm for any rate dR/dα.

The following table shows the angle α in respect to the radius R between 0° and 290° of the cam 3:

| Angle/° | R/mm |
|---|---|
| 0 | 45.63 |
| 5 | 48.55 |
| 10 | 51.46 |
| 15 | 54.45 |
| 20 | 57.45 |
| 25 | 60.32 |
| 30 | 63.06 |
| 35 | 65.68 |
| 40 | 68.18 |
| 45 | 70.57 |
| 50 | 72.85 |
| 55 | 75.02 |
| 60 | 77.10 |
| 65 | 79.07 |
| 70 | 80.96 |
| 75 | 82.76 |
| 80 | 84.47 |
| 85 | 86.11 |
| 90 | 87.67 |
| 95 | 89.17 |
| 100 | 90.60 |
| 105 | 91.97 |
| 110 | 93.29 |
| 115 | 94.52 |
| 120 | 95.57 |
| 125 | 96.61 |
| 130 | 97.66 |
| 135 | 98.72 |
| 140 | 99.78 |
| 145 | 100.9 |
| 150 | 101.9 |
| 155 | 103.0 |
| 160 | 104.1 |
| 165 | 105.2 |
| 170 | 106.4 |
| 175 | 107.5 |
| 180 | 108.7 |
| 185 | 109.9 |
| 190 | 111.1 |
| 195 | 112.3 |
| 200 | 113.6 |
| 205 | 114.8 |
| 210 | 116.1 |
| 215 | 117.3 |
| 220 | 118.6 |
| 225 | 119.8 |
| 230 | 121.1 |
| 235 | 122.3 |
| 240 | 123.5 |
| 245 | 124.7 |
| 250 | 125.8 |
| 255 | 126.6 |
| 260 | 127.2 |
| 265 | 127.6 |
| 270 | 128.0 |
| 275 | 128.2 |
| 280 | 127.7 |
| 285 | 126.5 |
| 290 | 124.1 |

With the proposed rate dR/dα of ≤0.28 mm/° at least in the range between 92 mm and 115 mm and between 105° and 200° the cam 3 yields in low closing velocity during the impact of the circuit breaker's 2 arcing contact.

While the invention has been illustrated and described in detail in the drawings and foregoing description, such illustration and description are to be considered illustrative or exemplary and not restrictive; the invention is not limited to the disclosed implementations. Other variations to be disclosed implementations can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting scope.

REFERENCE SIGNS LIST

1 spring drive
2 circuit breaker
3 spring drive cam
4 conducting terminal
5 conducting terminal
6 interrupter
7 opening spring
8 closing spring
9 roller
10 linkage
11 rotation axis
α angle
$\alpha_0$ base angle
R radius
dR/dα rate

The invention claimed is:

1. A spring drive cam for a spring drive of a circuit breaker comprising a flat cam profile configured to rotate around a rotation axis in the spring drive, wherein the flat cam profile comprises a radius (R) being the distance between a point of the cam profile and its axis of rotation that changes depending on an angle (α) of rotation relative to a base angle (α0) in an initial position of the cam, and a rate (dR/dα) defined by a change of the radius (R) per change of the angle (α) is ≤0.3 mm/° for the radius (R)≥82 mm and ≤125 mm and the angle (a)≥95° and ≤210°, and wherein the spring drive cam is attached to a closing spring.

2. The spring drive cam according to claim 1, wherein the rate (dR/dα) is <0.28 mm/°, 0.28 mm/° and/or constant.

3. The spring drive cam according to claim 1, wherein, for the rate (dR/dα)≤0.28 mm/°, the radius (R) is ≥92 mm and ≤115 mm.

4. The spring drive cam according to claim 1, wherein, for the rate (dR/dα)≤0.28 mm/°, the angle (α) is ≥105° and ≤200°.

5. The spring drive cam according to claim 1, wherein, for any rate (dR/dα), the radius (R) is ≥40 and ≤130 mm.

6. The spring drive cam according to claim 1, wherein, for the radius (R)<82 mm and the angle (α)<95°, the rate (dR/dα) is >0.3 mm/or, for the radius (R)<92 mm and the angle (α)<95°, the rate (dR/dα) is greater than 0.3 mm/° and/or, for the radius (R)>125 mm and the angle (α)>210° the rate (dR/dα) is ≤0.3 mm/° or, for the radius (R)>115 mm and the angle ($\alpha$)>200° the rate ($dR/d\alpha$) is <0.3 mm/°.

7. The spring drive comprising the spring drive cam according to claim 1, an opening spring configured to open the circuit breaker and a closing spring configured to close the circuit breaker and reload-ing the opening spring, wherein the opening spring and the closing spring are in rotational contact with the spring drive cam.

8. The spring drive according to claim 7, wherein the rate ($dR/d\alpha$)≤0.3 mm/° yields a rotational speed of the cam (3) of ≤4600°/s.

9. The circuit breaker comprising the spring drive according to claim 7 and a couple of conducting terminals, wherein the spring drive is configured to move at least one of the conducting terminals for electrically connecting and disconnecting the conducting terminals.

10. The circuit breaker according to claim 9, wherein one of the conducting terminals is provided as contact plug and the other of the conducting terminals is provided as corresponding contact tulip, whereby the conducting terminals are arranged in coaxial arrangement and at least one of the conducting terminals is arranged movable relative to the other of the of the conducting terminals.

11. The spring drive cam according to claim 1, wherein the closing spring is attached to the spring drive cam at a rotational axis of the spring drive cam.

* * * * *